United States Patent [19]

Elbaum

[11] Patent Number: 4,630,952

[45] Date of Patent: Dec. 23, 1986

[54] DESIGN PAINTING DEVICE WITH STABILITY AND INDEPENDENT DRIVE

[76] Inventor: Saul Elbaum, 11702 Kemp Mill Rd., Silver Spring, Md. 20902

[21] Appl. No.: 728,348

[22] Filed: Apr. 29, 1985

[51] Int. Cl.[4] ..... B43M 11/02; B05C 17/02

[52] U.S. Cl. ..... 401/48; 15/24; 15/27; 101/330; 401/208; 401/218

[58] Field of Search ..... 401/218, 48, 21, 208, 401/219, 220; 15/27, 24, 50 C; 101/328, 329, 330, 331

[56] References Cited

U.S. PATENT DOCUMENTS

| | | | |
|---|---|---|---|
| 172,067 | 1/1876 | Alexander | 15/24 |
| 894,011 | 7/1908 | Kampfe | 15/27 X |
| 913,189 | 2/1909 | Bary | 401/218 |
| 979,300 | 12/1910 | Hill | 401/218 |
| 1,491,625 | 4/1924 | Porter et al. | 401/48 |
| 1,829,589 | 10/1931 | Georgas | 15/24 |
| 2,485,428 | 10/1949 | Blieier et al. . | |
| 2,536,291 | 1/1951 | Kaitul | 401/218 |
| 2,548,580 | 4/1951 | Bick . | |
| 2,678,002 | 5/1954 | Roell, Jr. et al. | 101/330 |
| 2,833,073 | 5/1958 | Doggett . | |
| 3,138,814 | 6/1964 | Carrona | 401/218 X |
| 3,241,175 | 3/1966 | Johnson . | |
| 3,905,295 | 9/1975 | Bielesch et al. . | |

FOREIGN PATENT DOCUMENTS

| | | | |
|---|---|---|---|
| 817706 | 10/1951 | Fed. Rep. of Germany | 101/329 |
| 1083716 | 6/1960 | Fed. Rep. of Germany . | |
| 329770 | 2/1903 | France | 401/147 |
| 457080 | 5/1950 | Italy | 401/218 |
| 14024 | of 1890 | United Kingdom | 401/21 |
| 6606 | of 1903 | United Kingdom | 401/147 |
| 1295085 | 11/1972 | United Kingdom | 401/208 |

*Primary Examiner*—Steven A. Bratlie

[57] ABSTRACT

A device for painting wallpaper-like patterns on walls and other flat surfaces. The device comprises a container for holding paint as well as a series of feeder rollers for feeding paint onto the embossed surface of a pattern roller. Additional means, independent of the pattern roller, provides turning power to rotate the feeder rollers at the same linear speed as the pattern roller.

16 Claims, 7 Drawing Figures

DESIGN PAINTING DEVICE WITH STABILITY AND INDEPENDENT DRIVE

This invention relates to design painting devices which enable wallpaper-like patterns to be painted directly on walls and other flat surfaces.

Design painting devices are generally characterized by a design roller having a pattern embossed on its surface, and a series of transfer rollers which feed paint up from a container onto the surface of the design roller for application to the wall. In prior art devices, the design roller is made to turn by virtue of the friction developed between itself and the wall. This motion is, in turn, applied to each of the transfer rollers.

One of the most serious drawbacks of these prior art devices is the fact that a sufficient amount of friction is often not developed between the pattern roller and the wall, especially in the case of walls which have been painted with a gloss or semi-gloss finish. This lack of sufficient friction causes the pattern roller to slip rather than to turn along the wall, which causes the pattern to smear on the wall.

Another serious problem with prior art devices is that a very steady hand is required in order to paint a precise pattern on the wall. Since the only point of contact between the prior art device and the wall is the point at which the pattern roller is applying wet paint to the wall, even slight lateral movements of the hand may cause the design roller to move laterally, thereby causing a smear on the wall. This problem becomes particularly severe when the operator is attempting to climb down from a ladder while simultaneously holding the instrument steady against the wall.

Over the years numerous methods have been proposed for dealing with these problems. The most common solution involves the simple avoidance of glossy or slippery walls; however, that merely avoids the problem rather than solving it. Another solution has been to thin the paint and/or to add grit powder such as pumice powder to the paint; however, thinning the paint tends to reduce its pigmentation level and adding powder introduces undesired elements into the paint. Another solution has been to apply a deglossing agent to the wall prior to applying the design, but this is both very time-consuming and tedious.

Perhaps the most effective solution has been to set aside a portion at each end of the design roller as a pair of unpainted rings which, since they always remain in dry contact with the wall, do develop sufficient friction to turn all the rollers. These rings, however, reduce the space available for the design and require the use of smaller and disconnected designs such that a continuous painted pattern cannot be applied to the wall.

It is, therefore, a primary object of this invention to provide a design painting device which avoids slipping even when applied to slippery walls and other surfaces.

It is another object of this invention to provide a design painting device which has means, independent of the pattern roller, for driving the feeder roller at the same linear speed as the pattern roller.

Another object of this invention is to provide a design painting device which has means, independent of the pattern roller, for making dry contact with the wall so as to avoid lateral movement along the wall.

Another object of this invention is to provide a design painting device which utilizes at least one friction roller in dry contact with the wall, together with means for transferring rotary motion from the friction roller to at least one of the feeder rollers.

Still another object of this invention is to provide a rotary motion transfer mechanism along the side of the paint container, and to reposition the mechanism from one side of the container to the other side.

These and other objects of this invention will become more apparent from the following description, specification and claims appended thereto.

Briefly, in accordance with this invention, the device for painting wallpaper-like patterns directly on walls comprises a container for holding paint as well as one or more feeder rollers for feeding paint from the container onto the surface of a pattern roller which, as it rolls along the wall, transfers a painted pattern on the wall. Means, independent of the pattern roller, are provided for driving at least one feeder roller at the same speed as the design roller. At least one friction roller makes dry contact with the wall such that undesired lateral movements are avoided.

The invention will be better understood by reference to the specification and claims, as well as to the drawings which are briefly described as follows:

Figure 1:
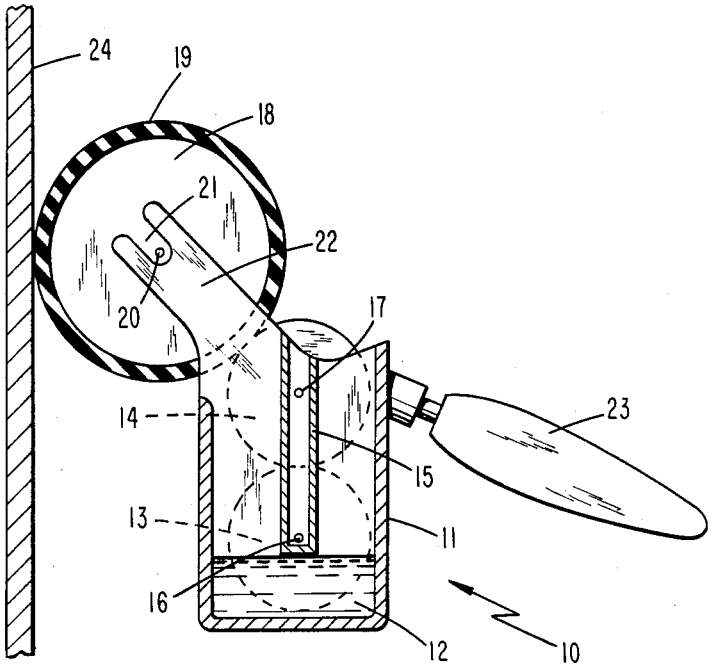
FIG. 1 PRIOR ART
FIG. 1 illustrates the prior art as it existed before this invention.

Specific embodiments of the invention can be best understood by referring first to FIG. 1 which is illustrative of the prior art. Design painting device 10 comprises a container 11 which holds a pigmented liquid 12 such as paint and the like. Feeder rollers 13 and 14 are positioned one on top of the other within the container and are retained in rolling contact by a U-shaped channel 15 secured to the inside wall of container 11. Pins 16 and 17 extend outwardly from the axis of feeder rollers 13 and 14 and fit into channel 15 so as to maintain feeder rollers 13 and 14 in their upright postion. The identical arrangement exists on the opposite inside wall of container 11.

Pattern roller 18, having a design 19 embossed on its surface, is secured by a pin 20 which extends outwardly from its axis and is held in place by a slot 21 within an extension 22 of container 11.

In operation, the user grabs handle 23 and presses pattern roller 18 against a wall 24 while rolling the pattern roller against the wall, generally from top to bottom. This rolling action causes paint 12 to be fed up onto the surface of feeder rollers 13 and 14, then onto the surface 19 of pattern roller 18, and finally onto wall 24, such that the design 19 is painted on wall 24 to look substantially like wallpaper.

The key to successful operation of the prior art device illustrated in FIG. 1 is that a sufficient amount of friction must be developed between surface 19 and wall 24 to not only drive pattern roller 18, but to drive feeder rollers 14 and 13 as well. Since feeder roller 13 sits inside paint 12 which can at times be very viscous, a considerable degree of friction must be developed at the wall to cause the entire mechanism to roll. The problem of developing sufficient friction is severely aggravated when wall 24 has been painted with a slick surface such as semi-gloss or high-gloss paint. In such cases there is often not a sufficient amount of friction developed to drive the entire mechanism. This causes design roller 18 to slide rather than turn on the wall, thereby causing the pattern to smear on the wall. Also, because the only point of contact between the slick wall and the device 10 is the point at which wet paint is applied, even slight lateral movements of the hand may result in undesired lateral movement of the pattern roller across the wall.

Figure 2:
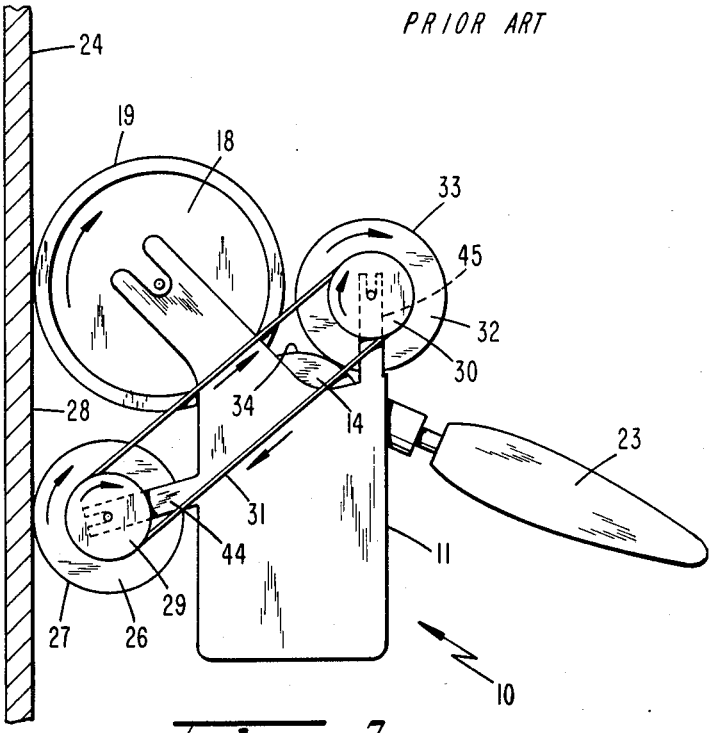
FIG. 2 illustrates one embodiment of this invention.

The aforementioned problems are solved by this invention as illustrated in the embodiment of FIG. 2. Here again design painting device 10 comprises a container 11 which holds a plurality of feeder rollers and paint (not shown) for transferring a design 19 from pattern roller 18 onto wall 24.

With this invention, however, additional turning power and support is developed by the use of a friction roller 26 which has a layer of rubber or other friction-causing material 27 on its surface. Friction roller 26 is located beneath design roller 18 and makes wall contact in the yet-to-be painted area 28 of the wall. This surface 27 of friction roller 26 always makes dry contact with dry area 28 of the wall and, therefore, always develops sufficient turning power to drive the entire mechanism while simultaneously resisting undesired lateral motion across the wall.

Figure 3:
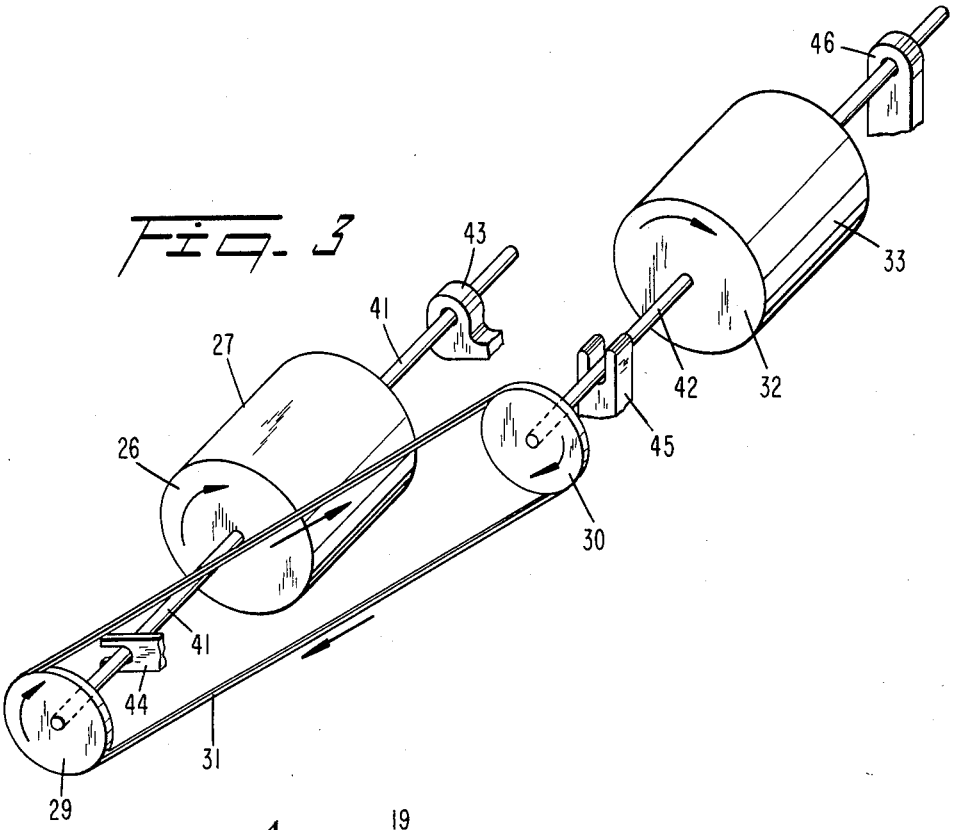
FIG. 3 is a perspective view of the drive transfer mechanism used in the embodiment of FIG. 2.

The manner in which turning power is transferred from friction wheel 26 is best understood by reference to FIG. 2 and FIG. 3 simultaneously. As friction wheel 26 is made to turn clockwise by virtue of the friction contact developed between its surface 27 and dry wall area 28, this clockwise motion is transferred to first pulley wheel 29 by way of drive shaft 41 and to second pulley wheel 30 by way of drive belt 31. Driver roller 32 receives the same clockwise motion by way of drive shaft 42 and its surface 33 makes circumferential contact (see FIG. 2) with surface 34 of feeder roller 14. The circumferential contact between surface 33 and surface 34 causes feeder roller 14 to turn in a counter-clockwise direction, thus perfectly complementing the clockwise direction of pattern roller 18 which also makes contact with feeder roller 14.

Drive shafts 41 and 42 are secured to container 11 by retaining members 43, 44, 45 and 46. Drive belt 31, in addition to transferring rotary motion between first pulley wheel 29 and second pulley wheel 30, also serves to hold the pulley wheels securely together as they are also supported by retaining members 44 and 45.

In order to insure that feeder roller 14 is driven at the same linear speed as the linear speed of pattern roller 18, it is necessary that the ratio of the outside diameter of the first pulley wheel 29 to the outside diameter of the friction roller 26 is the same as the ratio of the outside diameter of the second pulley wheel 30 to the outside diameter of the driver roller 32. As long as these two ratios are made equal, pattern roller 18, friction roller 26, driver roller 32 and feeder roller 14 will all turn at the same linear speed.

In operation, the user grips handle 23 and presses both pattern roller 18 and friction roller 26 against wall 24. As the entire assembly is made to travel down the wall, rotary motion generated by friction roller 26 is transferred to driver roller 32 by way of pulley wheels 29 and 30 and drive belt 31. Friction contact between driver roller 32 and feeder roller 14 causes the feeder rollers as well as pattern roller 18 to be driven by a force in addition to the small amount of frictional force normally generated between surface 19 (which is wet with paint) and the slick wall 24. Thus, device 10 now makes dry contact and wet contact with the wall and this dry contact provides both stability against lateral movement as well as the necessary turning power to turn all rollers at the same linear speed.

As is apparent from FIGS. 2,4 and 5–7, the stability against lateral movements and the additional turning power are provided by the combination of the friction roller 27 and the associated drive mechanisms, both of which are independent of the pattern roller. In the context of this invention, independent of the pattern roller is understood to mean that the friction roller and drive mechanism are not mechanically linked to the pattern roller such as by gears, belts, shafts or the like. The pattern roller 19 continues to rotate within its slots 21 on a free-wheeling basis while resting on feeder roller 14 just as in the case of the prior art illustrated in FIG. 1.

In order to enable pattern roller 18 to paint as close as possible to the corner of any wall, drive belt 31, pulley wheels 29 and 30, friction wheel 26 and driver wheel 32 can be removed and replaced on the opposite side of container 11. Thus, as the device 10 arrives at the right hand side of wall 24, the drive belts, pulley wheels, etc. are simply removed from the right hand side of device 11 and replaced at the left hand side.

Figure 4:
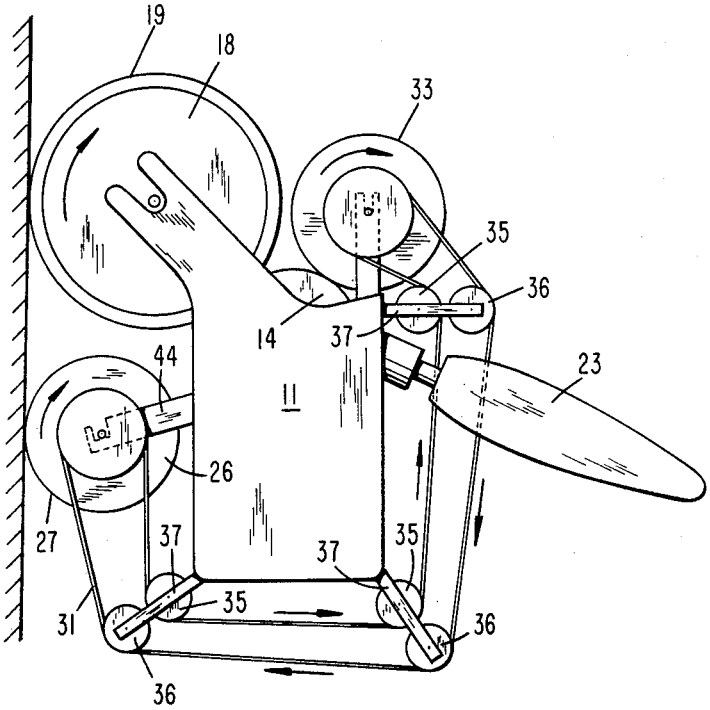
FIG. 4 illustrates another embodiment of this invention.

In FIG. 4 the drive belt 31 is looped underneath container 11 and held in place by means of a plurality of idler pulley wheels 35 and 36, each of which is secured to container 11 by means of a support arm 37. Thus, in this embodiment the sides of container 11 are always clear, thereby avoiding the necessity of removing and repositioning the drive belt and pulley wheels as is the case with the embodiment shown in FIG. 2.

Figure 5:
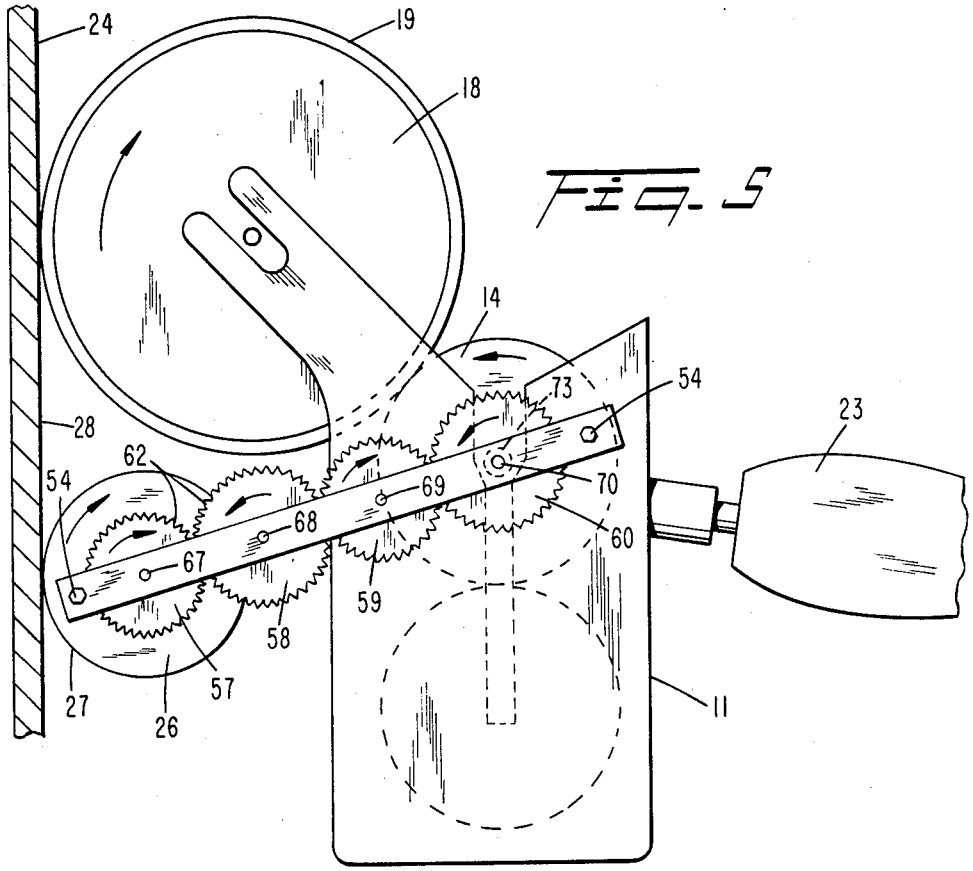
FIG. 5 illustrates another embodiment of this invention.
Figure 6:
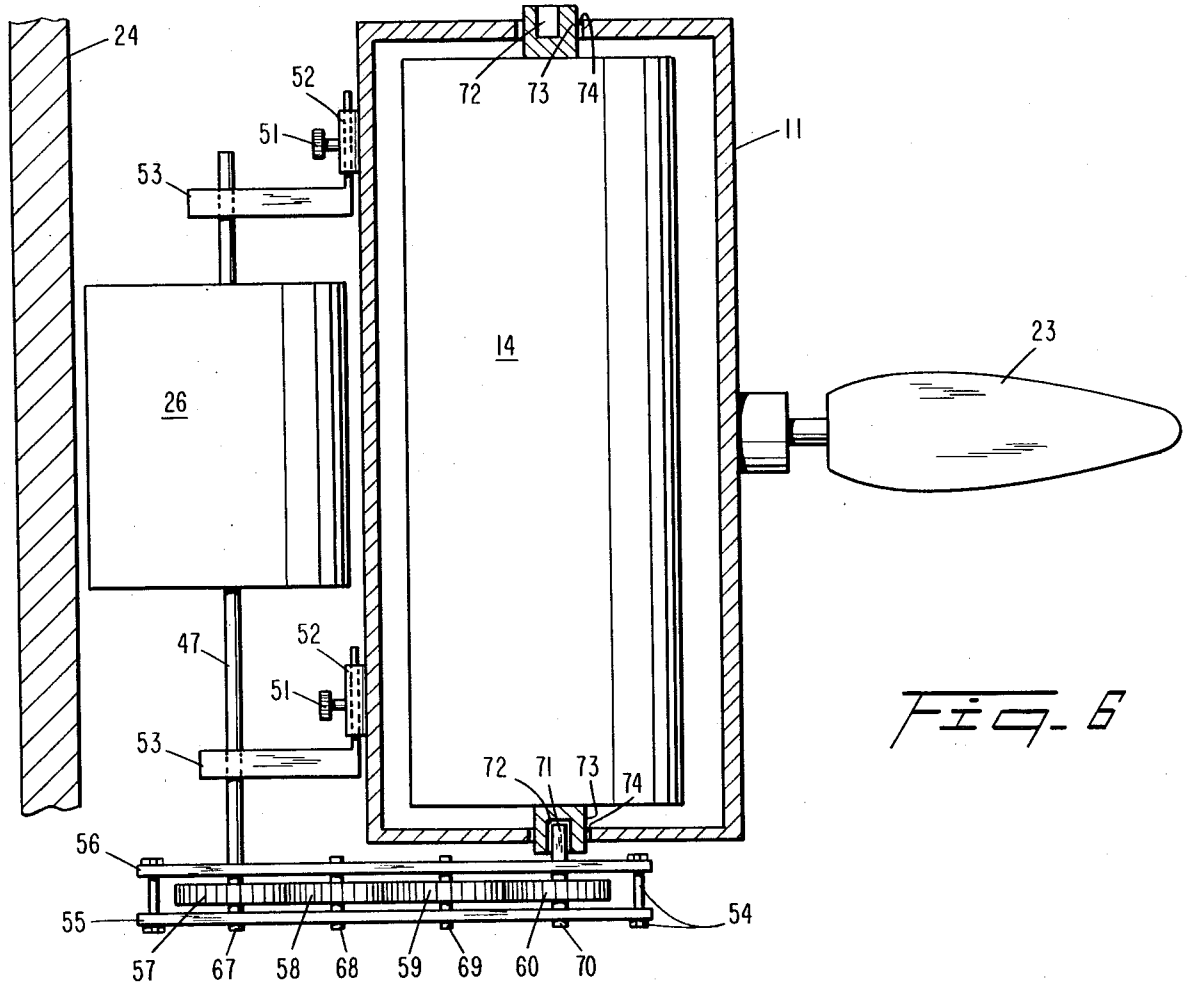
FIG. 6 is a top view of the embodiment shown in FIG. 5.

In the embodiment illustrated in FIGS. 5 and 6, rotary motion generated by friction roller 26 is transferred to feeder roller 14 axially rather than circumferentially. This is best illustrated in FIG. 6 which is a top view of the device shown in FIG. 5 with pattern roller 18 having been removed. Shaft 73 extends outwardly from the axis of feeder roller 14 through an opening 74 in the side of container 11. An identical arrangement exists on the opposite side of container 11.

Sleeve 73 has a rounded exterior and contains a square hole 72 for receiving the squared end 71 of dowel pin 70. Dowel pins 67, 68, 69 and 70 support rollers 57, 58, 59 and 60, respectively, and are all held in place by a pair of support bars 55 and 56 which are secured together by a bolt and hex nut arrangement 54. Shaft 47, which is secured to container 11 by one or more supporting arms 53, also supports friction roller 26. Supporting arms 53 are secured to container 11 by way of elongated sleeves 52 and thumb screw knobs 51. Each of rollers 57, 58, 59 and 60 are provided with a notched or geared surface 62 to facilitate the transfer of rotary motion.

In operation, the user grips handle 23 and presses both pattern roller 18 and friction roller 26 against wall 24. As the entire assembly is made to travel down the wall, rotary motion generated by friction roller 26 is transmitted to receiving roller 57 by way of shaft 47 and dowel pin 67. Receiving roller 57 turns clockwise, just as does friction roller 26 and pattern roller 18. The clockwise motion of roller 57 is converted to counter-clockwise motion of transfer roller 58, back to clockwise motion of transfer roller 59, and again to counterclockwise motion of driver roller 60 which axially drives feeder roller 14, by means of square shaft 71, in a counterclockwise direction. As can be seen in FIG. 5, the counterclockwise motion of feeder roller 14 perfectly complements and drives pattern roller 18 in its intended clockwise direction.

In order to insure that feeder roller 14 is driven at the same linear speed as that of pattern roller 18, it is necessary that the ratio of the outside diameter of the receiving roller 57 to the outside diameter of the friction roller 26 is the same as the ratio of the outside diameter of the driver roller 60 to the outside diameter of the feeder roller 14. As long as these two ratios are made equal, pattern roller 18, friction roller 26 and feeder roller 14 will all turn at the same linear speed. The diameters of transfer rollers 58 and 59 are not important, although for production purposes, rollers 57, 58, 59 and 60 should all have the same diameters, and friction roller 26 should have the same diameter as feeder roller 14.

In order to enable pattern roller 18 to paint as closely as possible to the corner of any wall, the entire drive mechanism, starting from friction roller 26 and extending to the plurality of transfer rollers 57, 58, 59 and 60, can be removed and replaced at the opposite side of container 11. The entire drive mechanism is removable by loosening thumb screw knobs 51, thus enabling the drive mechanism to slip out and be replaced in its corresponding location along the opposite side of container 11.

Figure 7:
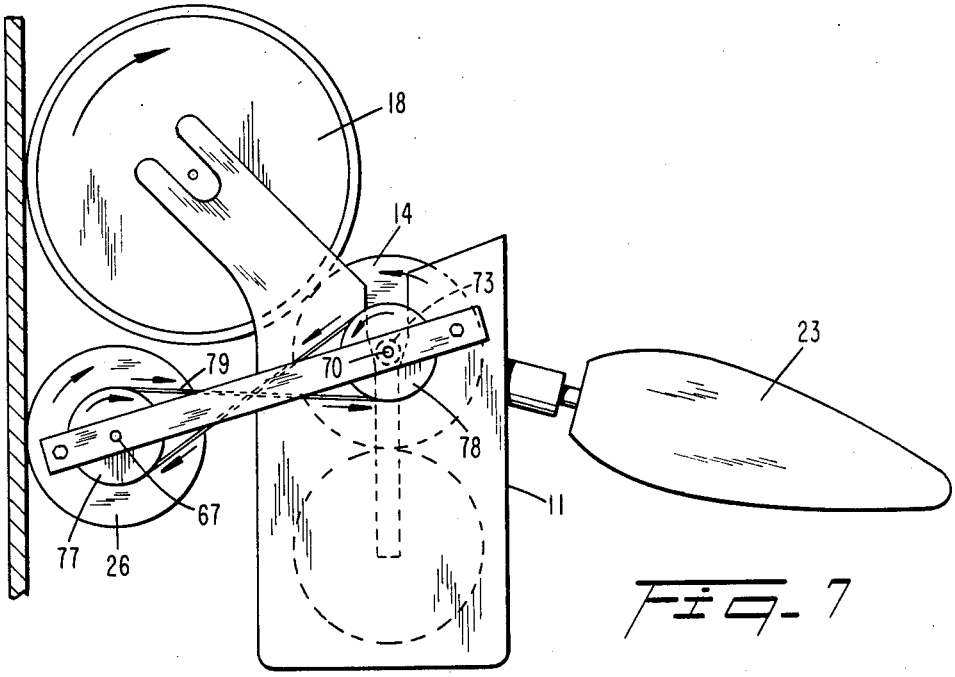
FIG. 7 illustrates another embodiment of this invention.

The embodiment illustrated in FIG. 7 is a modification of the embodiment shown in FIGS. 5 & 6 in that transfer rollers 58 and 59 have been replaced by a drive belt 79. Instead of a gear drive mechanism, the embodiment of FIG. 7 utilizes a pulley roller 77 and a driver roller 78 connected by a drive belt which is crossed such that clockwise motion of pulley roller 77 is converted to counterclockwise motion of driver roller 78. Feeder roller 14 is driven axially by driver roller 78 in the same counterclockwise motion so as to perfectly complement the clockwise direction of pattern roller 18. In order to insure that feeder roller 14 drives pattern roller 18 at the correct speed, it is necessary that the ratio of the outside diameter of pulley roller 77 to friction roller 26 be same as the ratio of the outside diameter of driver roller 78 to feeder roller 14. In the preferred case, friction roller 26 would have the same diameter as feeder roller 14, and pulley roller 77 would have the same diameter as driver roller 78.

Although specific examples and embodiments have been presented in the specification, these should be understood to be exemplary only and not to limit the spirit and scope of the invention which is defined by the appended claims.

I claim as my invention:

1. A device for painting wallpaper-like patterns on walls comprising:

(a) a container for holding paint;

(b) a pattern roller for applying a pattern as it is manually driven by friction contact between itself and a wall;

(c) at least one feeder roller which is driven by friction contact with said pattern roller;

(d) a friction roller, independent of said pattern roller, for providing stability and avoiding lateral movements of said device across said wall;

(e) a driver roller for driving said feeder roller; and (f) means for transferring rotary motion from said friction roller to said driver roller such that said feeder roller rotates at the same linear speed at which said pattern roller is manually driven along said wall.

2. The device of claim 1 wherein said driver roller is in axial contact with said feeder roller.

3. The device of claim 2 wherein said means for transferring rotary motion comprises a pulley wheel axially connected to said friction roller and a drive belt and wherein the ratio of the outside diameter of said pulley wheel to the outside diameter of said friction roller is the same as the ratio of the outside diameter of said driver roller to the outside diameter of said feeder roller.

4. The device of claim 2 wherein said means for transferring rotary motion comprises a receiving roller axially connected to said friction roller and at least one transfer roller circumferentially connected to said receiving roller and to said driver roller.

5. The device of claim 4 wherein the ratio of the outside diameter of said receiving roller to said friction roller is the same as the ratio of the outside diameter of said driver roller to said feeder roller.

6. The device of claim 5 wherein said receiving roller, said driver roller and said transfer roller have geared or notched surfaces.

7. The device of claim 5 wherein said receiving roller, said driver roller and said transfer roller are positioned along at least one side of said container and further comprising means for removing and repositioning said receiving roller, said transfer roller, and said driver roller along the opposite side of said container.

8. The device of claim 7 wherein said friction roller is positioned directly below said pattern roller such that said friction roller always makes dry contact with said wall as said pattern roller is manually driven from the top to the bottom of said wall.

9. The device of claim 5 wherein said driver roller is axially connected to the topmost feeder roller and wherein an even number of transfer rollers are circumferentially connected between said driver roller and said receiving roller.

10. The device of claim 1 wherein said driver roller is in circumferential contact with said feeder roller.

11. The device of claim 10 wherein said means for transferring rotary motion comprises a first pulley wheel axially connected to said friction roller, a second pulley wheel axially connected to said driver roller and a means for transmitting rotary motion from said first pulley wheel to said second pulley wheel.

12. The device of claim 11 wherein the ratio of the outside diameter of said first pulley wheel to the outside diameter of said friction roller is the same as the ratio of the outside diameter of said second pulley wheel to the outside diameter of said driver roller.

13. The device of claim 12 wherein said means for transmitting rotary motion between first and second pulley wheels comprises a drive belt.

14. The device of claim 13 wherein said pulley wheels and drive belt are positioned along at least one side of said container and further comprising means for removing and repositioning said pulley wheels and drive belt, to the opposite side of said container.

15. The device of claim 6 wherein said friction roller is positioned directly below said pattern roller such that said friction roller always makes dry contact with said wall as said pattern roller is manually driven from the top to the bottom of said wall.

16. The device of claim 13 wherein said pulley wheels and drive belt are positioned between the sides of said container, and further comprising a plurality of idler rollers positioned around said container for supporting said drive belt.

* * * * *